US006830078B2

(12) United States Patent
Kuo

(10) Patent No.: US 6,830,078 B2
(45) Date of Patent: Dec. 14, 2004

(54) WEAVING STRUCTURE IMPROVEMENT OF TRAMPOLINE FABRIC

(75) Inventor: Hsien Chung Kuo, Chang Hwa Hsien (TW)

(73) Assignee: Hun Kun Enterprise Co., Ltd., Chang Hwa Hsien (TW)

( * ) Notice: Subject to any disclaimer, the term of this patent is extended or adjusted under 35 U.S.C. 154(b) by 60 days.

(21) Appl. No.: 10/164,002

(22) Filed: Jun. 7, 2002

(65) Prior Publication Data

US 2003/0226614 A1 Dec. 11, 2003

(51) Int. Cl.[7] ..... D03D 1/00
(52) U.S. Cl. ..... 139/384 R; 139/420 R
(58) Field of Search ..... 139/383 R, 384 R, 139/416–419, 118, 420 R; 442/203, 181

(56) References Cited

U.S. PATENT DOCUMENTS 2,619,705 A * 12/1952 Foster ..... 428/219
3,464,459 A * 9/1969 Ballard ..... 139/383 R
4,636,426 A * 1/1987 Fleischer ..... 442/149
5,150,738 A * 9/1992 Nishiwaki ..... 139/420 R
5,958,804 A * 9/1999 Brown, Jr. et al. ..... 442/192

* cited by examiner

*Primary Examiner*—Danny Worrell
(74) *Attorney, Agent, or Firm*—Troxell Law Office PLLC

(57) ABSTRACT

The present invention relates to the weaving structure improvement of trampoline fabric, and more particularly to a weaving structure of trampoline fabric that is able to increase strength, shorten manufacturing process, and saving processing time cost. The present invention mainly uses the basket weaving method to interweave multiple warp yarns with multiple weft yarns, wherein each warp yarn is a yarn unit that is constructed by combining at least three single yarns and is used as a warp yarn weaving unit, while each interweaved weft yarn is a yarn unit that is constructed by combining at least two single yarns and every two weft yarns lined up side-by-side are used as a weft yarn weaving unit. The weaving structure of trampoline fabric is constructed by the way of interweaving the warp yarn weaving unit up and down alternately at a fixed distance with the weft yarn weaving unit, which not only is able to increase the strength of weaving fabric, but also greatly reduce the space occupied by equipment and manufacturing processing time.

2 Claims, 4 Drawing Sheets

WEAVING STRUCTURE IMPROVEMENT OF TRAMPOLINE FABRIC

BACKGROUND OF THE INVENTION (1) Field of the Invention

The present invention relates to the weaving structure improvement of trampoline fabric, and more particularly to a weaving structure of trampoline fabric that is able to increase fabric strength, shorten manufacturing process, and save processing time cost.

(2) Description of the Prior Art

Generally, the usage of trampoline can be seen in sports and fitness functions, cheerleader performances, circuses, and also children playing areas. The structure of trampoline not only has to withstand the basic weight of the jumper, but also has to withstand the jumping impact generated by the jumper. Therefore, the safety requirement of the trampoline fabric is quite high. However, most trampoline fabrics of the prior art utilize the 'basket weaving' method, as shown in FIG. 1, wherein the weaving unit is constituted of three side-by-side lined-up individual warps 11 interweaved at a fixed distance with four side-by-side lined-up individual wefts 12 to construct a roll of fabric (the individual yarns of warp and weft are shown in FIG. 2). Since warp 11 or weft 12 has to be weaved individually during the production process, it may yield several shortcomings:

1. The production method of interweaving individual warps 11 and individual wefts 12 has to weave one yarn at a time, a time consuming manufacturing process.

2. Please refers to FIG. 2 and FIG. 3. Each roll of fabric includes at least one hundred warps 11 and each warp 11 has to be accompanied by a warp winder 21. With a limited fabric width, it is impossible to accommodate so many warp winders 21. Therefore, warp winders 21 have to be laterally spread out into a fan-shape, i.e., the more warps are utilized, the bigger space is needed, and it has to use a draper warper 22 to organize warps in order for the weaving process to proceed smoothly. So when the number of warps 11 increases, the number of warp winders 21 has to increase as well. If without enough space, it has to organize warps section-by-section, so each section may not has the same tension and seriously affects weaving quality.

SUMMARY OF THE INVENTION

Because of the stated shortcomings of the prior weaving structure and weaving method of trampoline fabric, after years of experience in the industry and a sequence of continuous researches, developments, and improvements, I propose the present invention as a possible solution. The warp (weft) yarns of the present invention are drawn at once to form a three-yarn combined unit (or an at-least-two-yarn combined unit) and then are interweaved at a fixed distance using the basket weaving method to construct a weaving structure of trampoline fabric that is able to solve the shortcomings of the prior art.

The primary objective of the present invention is to provide the weaving structure improvement of trampoline fabric that is able to shorten weaving time, decrease the area occupied by equipment, and increase fabric strength at the same time.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to the weaving structural improvement of trampoline fabric. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
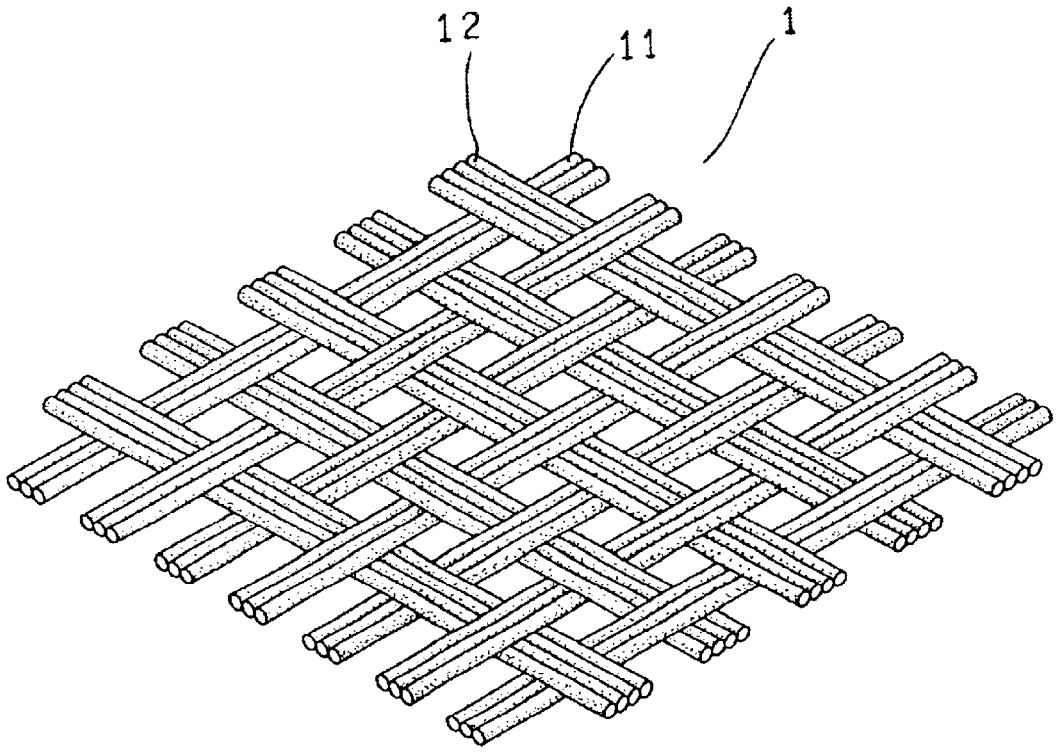
FIG. 1 PRIOR ART
FIG. 1 is a schematic view of a prior basket weaving structure of trampoline fabric.
Figure 2:
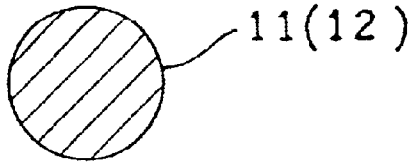
FIG. 2 PRIOR ART
FIG. 2 is a schematic cross-section view of the prior warp yarn and weft yarn.
Figure 4:
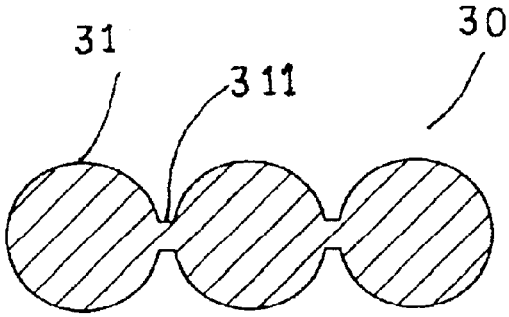
FIG. 4 is a schematic cross-section view of warp yarn in accordance with the present invention.
Figure 5:
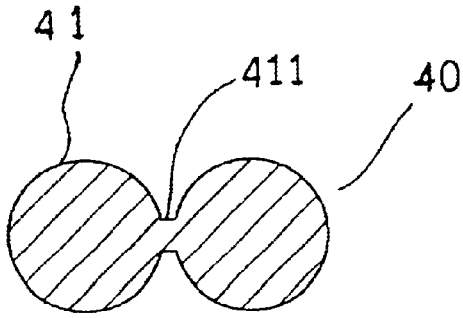
FIG. 5 is a schematic cross-section view of weft yarn in accordance with the present invention.
Figure 3:
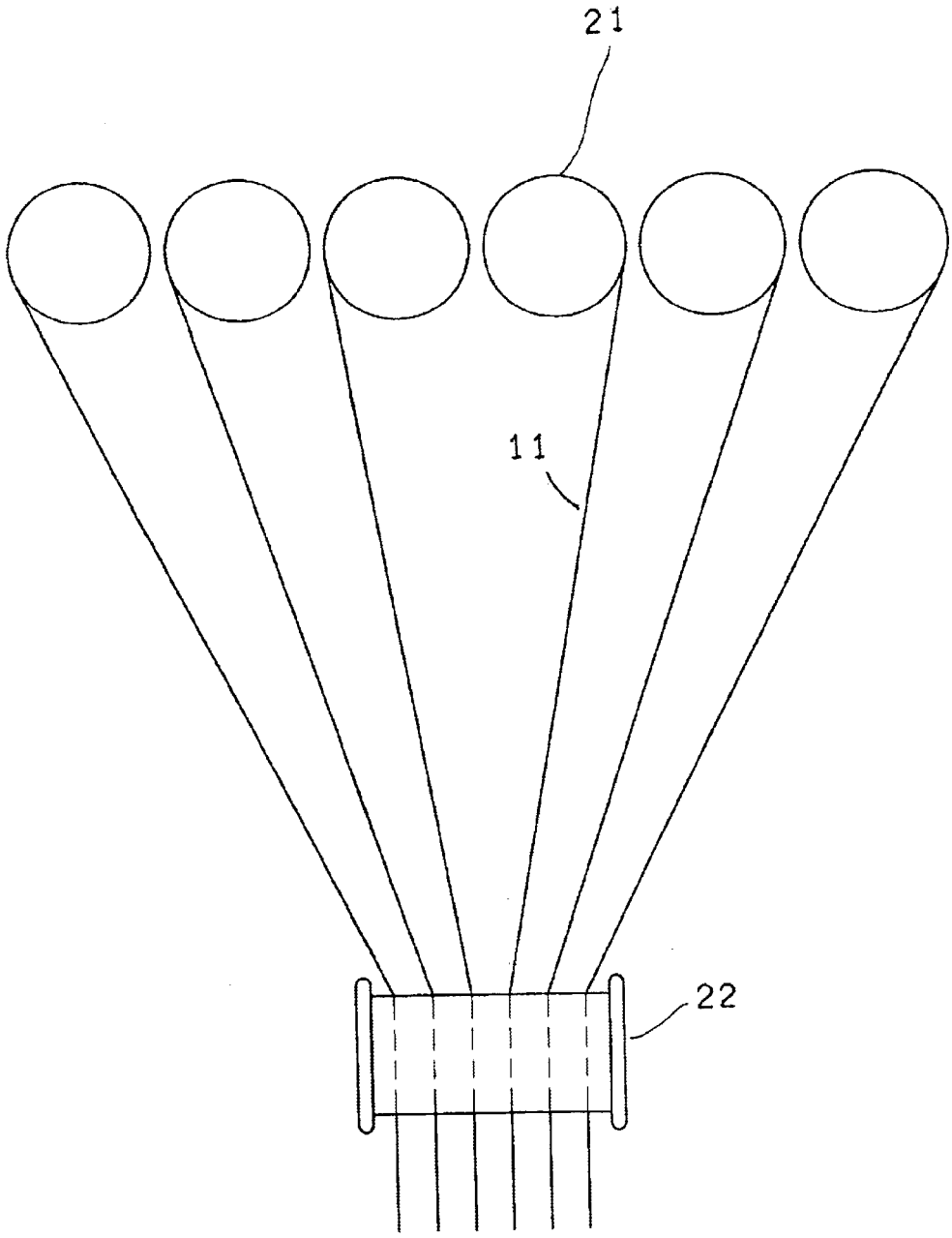
FIG. 3 PRIOR ART
FIG. 3 is a schematic view of a prior draper warper in use.
Figure 6:
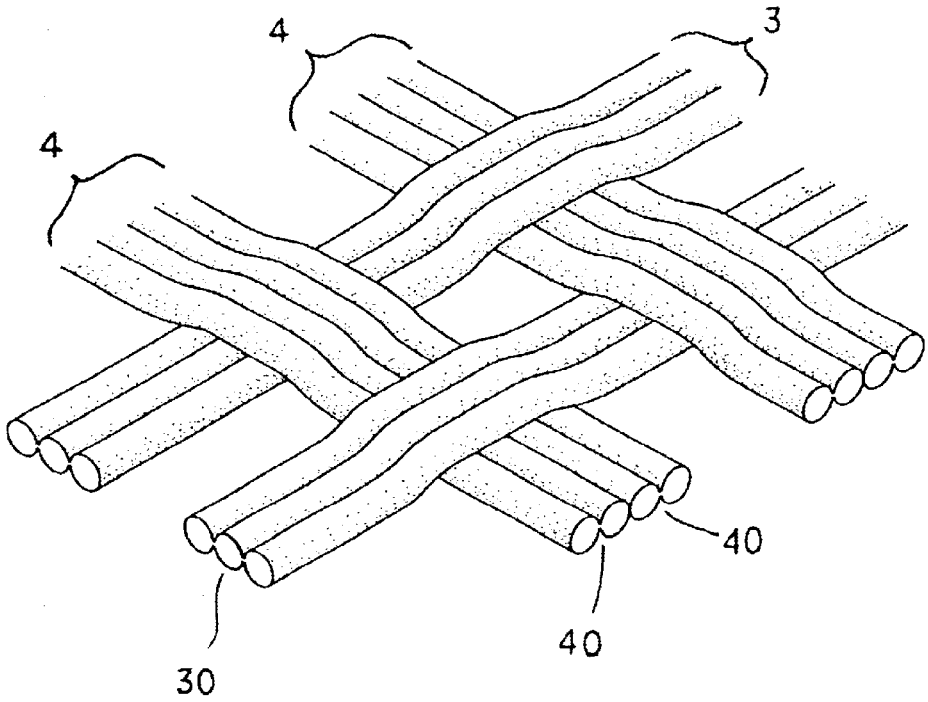
FIG. 6 is a schematic structure view of trampoline fabric in accordance with the present invention.

Please refer to FIG. 4 and FIG. 5, the schematic cross-section of the warp yarn 30 and the schematic cross-section of the weft yarn 40. In the present invention, multiple warp yarns 30 interweave with multiple weft yarns 40 using the basket weaving method, wherein each warp yarn 30 is a yarn unit that is constructed by combining at least three single yarns together and the warp yarn 30 is used as a warp yarn weaving unit 3, while each interweaved weft yarn 40 is a yarn unit that is constructed by combining at least two single yarns together and every two weft yarns lined up side-by-side are used as a weft yarn weaving unit 4. The weaving structure of trampoline fabric is constructed by the way of interweaving the warp yarn weaving unit 3 up and down alternately at a fixed distance with the weft yarn weaving unit 4.

The yarn unit of warp yarn 30 mentioned above is constructed by combining at least three single yarns together, which is drawn by an extruder to form a combined yarn unit, wherein the interconnected section between each single yarns 31 further includes a tendon 311; similarly, the yarn unit of weft yarn 40 is constructed by combining at least two single yarns together, which is drawn by an extruder to form a combined yarn unit as well, wherein the interconnected section between each single yarns 41 further includes a tendon 411.

In summation, every warp yarn in accordance with the present invention is a combined yarn constructed by combining at least three single yarns, which is able to reduce the number of corresponding warp winders and effectively decrease space occupied by equipment. In addition, the weft yarn is a combined yarn constructed by combining at least two single yarns, which is able to decrease the numbers of weft yarns going ups and downs through warp yarns and increase weaving speed. Each warp (or weft) weaving yarn is a combined yarn constructed by combining at least two single yarn (or at least three single yarns) formed by the way of drawing at once, which is able to increase the strength of trampoline fabric, so the present invention is practical and has made significant improvement.

While the present invention has been particularly shown and described with reference to a preferred embodiment, it will be understood by those skilled in the art that various changes in form and detail may be without departing from the spirit and scope of the present invention.

I claim:

1. A weaving structure for trampoline fabric comprising:

a) a plurality of warp yarn weaving units, each of the plurality of warp yarn weaving units having at least one warp yarn, each warp yarn having at least three single warp yarns and at least two warp tendons, wherein two adjacent single warp yarns are connected by one of the warp tendon; and b) a plurality of weft yarn weaving units, each of the plurality of weft yarn weaving units includes at least one weft yarn, each weft yarn having at least two single weft yarns and at least one weft tendon, wherein two adjacent single weft yarns are connected by the at least one weft tendon, wherein the trampoline fabric is formed by alternatively weaving the warp yarn weaving units and the weft yarn weaving units.

2. The weaving structure for trampoline fabric according to claim 1, wherein each of the plurality of warp yarn weaving units includes one warp yarn having three single warp yarns and two warp tendons connecting the three adjacent single warp yarns; and each of the plurality of weft yarn weaving units includes two weft yarns, each weft yarn having two single weft yarns and one weft tendon connecting the two adjacent single weft yarns.

* * * * *